US007295801B2

(12) United States Patent
Ohba

(10) Patent No.: US 7,295,801 B2
(45) Date of Patent: Nov. 13, 2007

(54) IMAGE FORMING DEVICE AND TRANSFER SHEET CONVEYANCE AND GUIDE MECHANISM THEREOF

(75) Inventor: Keisuke Ohba, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/306,858

(22) Filed: Jan. 13, 2006

(65) Prior Publication Data

US 2006/0198669 A1 Sep. 7, 2006

(30) Foreign Application Priority Data

Jan. 13, 2005 (JP) ..... 2005-006901

(51) Int. Cl.
*G03G 15/16* (2006.01)

(52) U.S. Cl. ..... 399/316

(58) Field of Classification Search ..... 399/121, 399/310, 316, 388
See application file for complete search history.

(56) References Cited

U.S. PATENT DOCUMENTS 4,708,457 A * 11/1987 Shimura ..... 399/316
5,565,975 A * 10/1996 Kumon et al. ..... 399/302
5,923,933 A * 7/1999 Anzai et al. ..... 399/269
6,256,472 B1 * 7/2001 Miyake et al. ..... 399/313
2005/0260015 A1 * 11/2005 Ito ..... 399/316

FOREIGN PATENT DOCUMENTS

JP 11/219042 A 8/1999

* cited by examiner

*Primary Examiner*—David M. Gray
*Assistant Examiner*—Ruth N. LaBombard
(74) *Attorney, Agent, or Firm*—Global IP Counselors, LLP

(57) ABSTRACT

An image forming device sheet conveyance and guide mechanism 6 has a first pre-transfer guide plate 61 and a second pre-transfer guide plate 62. The first pre-transfer guide plate 61 is provided on the transfer roller side upstream of the transfer nip in a transfer sheet conveying direction, and guides a transfer sheet into the transfer nip. The second pre-transfer guide plate 62 is provided opposite to the first pre-transfer guide plate 61 and on the photoconductive drum side upstream of the transfer nip in the transfer sheet conveying direction, and guides a transfer sheet into the transfer nip. The first pre-transfer guide plate 61 is provided with contact portions 64 protruding toward the second pre-transfer guide plate 62, and the second pre-transfer guide plate 62 is provided with semiconductor members 63 in contact with the contact portions 64.

10 Claims, 3 Drawing Sheets

IMAGE FORMING DEVICE AND TRANSFER SHEET CONVEYANCE AND GUIDE MECHANISM THEREOF

BACKGROUND OF THE INVENTION

1. Field of the Invention

The present invention relates to an image forming device. More particularly, the present invention relates to a transfer sheet conveyance and guide mechanism of an image forming device, and specifically to a transfer sheet conveyance and guide mechanism which guides a transfer sheet fed upward from a pair of paper stop rollers to a transfer nip between a photoconductive drum and a transfer roller.

2. Background Information

In an image forming device utilizing an electrophotographic system, a charging unit, an exposure unit, a developing unit, a transfer unit, a cleaning unit, and the like are arranged around a photoconductive drum as an image carrying member. A fixing device is provided downstream of the photoconductive drum in a transfer sheet conveying direction. In such an image forming device, the charging unit will first uniformly charge the surface of the photoconductive drum. Next, the exposure unit exposes the photoconductive drum based on image data to form an electrostatic latent image on the surface of the photoconductive drum. The electrostatic latent image is developed by the developing unit into a toner image, which is transferred to a transfer sheet by the transfer unit. The toner image on the transfer sheet is fixed by means of a fixing unit, and the transfer sheet on which the image is formed is discharged to a discharge unit.

One type of transfer unit in an image forming device is a transfer roller that is disposed so as to be in contact with the photoconductive drum and form a transfer nip therebetween. A transfer sheet is transported from a feeding unit to the transfer nip through a pair of paper stop rollers. At the transfer nip, a transfer bias voltage is applied to the transfer roller to transfer the toner image carried on the photoconductive drum to the transfer sheet. In order to obtain a fine image by precisely transferring the toner image held on the surface of the photoconductive drum to the transfer sheet, it will be necessary to precisely guide the transfer sheet transported from the pair of paper stop rollers to the transfer nip. Thus, a pair of pre-transfer guide plates are provided upstream of the transfer nip in a transfer sheet conveying direction in order to precisely guiding the transfer sheet transported from the pair of paper stop rollers to the transfer nip. Here, one of the pair of the pre-transfer guide plates is disposed on the transfer roller side, and the other is disposed on the photoconductive drum side, and the pre-transfer guide plate provided on the photoconductive drum side is connected to ground.

Recently, as multifunction devices having the functions of a copying machine and a printer have increased in number, there are more and more devices having a vertical transport path for upwardly transporting a transfer sheet, in which an image forming unit, a fixing unit, and so on are disposed in a vertical direction, in response to the need to miniaturize the device and speed up image formation. In a miniaturized image forming device having such a vertical transport path, a photoconductive drum and a transfer roller are designed to have smaller diameters. Accordingly, the space between the transfer roller and the pre-transfer guide plate provided on the transfer roller side, and the space between the pre-transfer guide plate provided on the transfer roller side and the pre-transfer guide plate provided on the photoconductive drum side are narrower.

Here, if an electrically conductive member is used as the material that forms the pre-transfer guide plate, when a transfer bias voltage is applied to the transfer roller in an image forming process, transfer bias current flows through the pre-transfer guide plate provided on the transfer roller side to ground. If the transfer bias current thus flows to ground, insufficient transfer potential will be applied from the transfer roller to the transfer sheet, thus generating a defective transfer. In addition, if an electrical insulator is used as the material that forms the pre-transfer guide plate in order to prevent the transfer bias current from escaping, when the transfer sheet passes by the pre-transfer guide plate, charge storage due to triboelectrification between the transfer sheet and the guide plate will occur, thus generating gray streaks on a formed image.

In the device shown in Japanese Patent Application Publication No. 11-219042, the transfer bias current is controlled in order to prevent defective transfer and transfer void.

In this conventional device, after a transfer sheet is fed into the transfer nip, current leakage from the transfer roller to the pre-transfer guide plate via the transfer sheet will be detected, and a controller will change the transfer bias to be applied to the transfer roller based on the detection result. However, in this device, both a detection circuit for detecting the current flowing into the pre-transfer guide plate and a controller have to be provided, resulting in an increased cost of the overall device. Additionally, if the pre-transfer guide plates are chipped due to friction with a transfer sheet in the image forming process, or if paper dust from the transfer sheets is adhered to the pre-transfer guide plates, the amount of current detected by the detection circuit will varies from an initial value, making it difficult to control the current.

In view of the above, there exists a need for a transfer sheet conveyance and guide mechanism of an image forming device which overcomes the above mentioned problems in the prior art. This invention addresses this need in the prior art as well as other needs, which will become apparent to those skilled in the art from this disclosure.

SUMMARY OF THE INVENTION

A transfer sheet conveyance and guide mechanism according to a first aspect of the present invention is utilized in an image forming device, the image forming device having an image carrying member having a surface on which an electrostatic latent image is formed, and a transfer member which is disposed opposite to the image carrying member so as to form a transfer nip with the image carrying member and to which a bias voltage is applied. The transfer sheet conveyance and guide mechanism includes a first pre-transfer guide plate and a second pre-transfer guide plate. The first pre-transfer guide plate is provided on the transfer member side upstream of the transfer nip in a transfer sheet conveying direction, and serves to guide a transfer sheet to the transfer nip. The second pre-transfer guide plate is provided opposite to the first pre-transfer guide plate and on the image carrying member side upstream of the transfer nip in the transfer sheet conveying direction, and serves to guide the transfer sheet to the transfer nip. The first pre-transfer guide plate is provided with a first contact portion protruding toward the second pre-transfer guide plate, and the second pre-transfer guide plate is provided with a first semiconductor member that is in contact with the first contact portion.

This mechanism guides a transfer sheet to the transfer nip by means of a pair of pre-transfer guide plates, one of which is provided on the image carrying member side and the other of which is provided on the transfer member side. A bias voltage is applied to the transfer member in order to transfer a toner image formed on the image carrying member to a transfer sheet passing through the transfer nip. Here, the pre-transfer guide plate is generally made of a non-electrical insulator. Accordingly, when the transfer sheet passes by the pre-transfer guide plates, it is possible to prevent charge storage due to triboelectrification between the transfer sheet and the pre-transfer guide plates, and thus prevent gray streaks from occurring in a formed image.

Note, however, that in a miniaturized image forming device, the space between the transfer member and the pre-transfer guide plate provided on the transfer member side, and the space between the pre-transfer guide plate provided on the transfer member side and the pre-transfer guide plate provided on the photoconductive drum side, are apt to be smaller. In a conventional transfer sheet conveyance and guide mechanism, as described above, when a bias voltage is applied to the transfer member, a transfer bias current flows through the pre-transfer guide plate provided on the transfer member side into the pre-transfer guide plate provided on the image carrying member side, and escapes to ground.

Therefore, in the mechanism according to the first aspect, a semiconductor member is provided on the second pre-transfer guide plate that is provided on the image carrying member side. A bias current flowing from the first pre-transfer guide plate provided on the transfer member side to the second pre-transfer guide plate provided on the image carrying member side is limited by the semiconductor member, and thus the bias current will rarely flow to ground. Accordingly, it is possible to further inhibit the occurrence of a defective transfer due to the escape of bias current to ground, compared to a situation in which there is no semiconductor member.

In a transfer sheet conveyance and guide mechanism of an image forming device according to a second aspect of the present invention, the first and second pre-transfer guide plates of the first aspect extend in a direction orthogonal to the transfer sheet conveying direction, and each of the first contact portion and the first semiconductor member of the first aspect is provided at one end of each of the pre-transfer guide plates in the lengthwise direction.

In a transfer sheet conveyance and guide mechanism of an image forming device according to a third aspect of the present invention, the first pre-transfer guide plate of the second aspect is provided with a second contact portion protruding toward the second pre-transfer guide plate at the other end in the lengthwise direction, and the second pre-transfer guide plate of the second aspect is provided with a second semiconductor member in contact with the second contact portion at the other end in the lengthwise direction.

In a transfer sheet conveyance and guide mechanism of an image forming device according to a fourth aspect of the present invention, each space between the first and second contact portions and the space between the first and second semiconductor members of the third aspect is wider than the width of the transfer sheet.

In a transfer sheet conveyance and guide mechanism of an image forming device according to a fifth aspect of the present invention, the second pre-transfer guide plate of the first aspect is a resin member whose resistance is adjusted by the addition of carbon, and the first semiconductor member of the first aspect is a sheet member having a volume resistivity of $10^9$ to $10^{14}$ Ωcm.

In this mechanism, the second pre-transfer guide plate is made of a resin member whose resistance is adjusted by the addition of carbon. The carbon resin member normally has a volume resistivity of $10^6$ to $10^{10}$ Ωcm. Accordingly, the bias voltage escaping to ground via the pre-transfer guide plate is less than that in a mechanism adopting the conventional pre-transfer guide plates made of an electrically conductive member.

With a transfer guide plate made of a resin member whose resistance is adjusted by the addition of carbon, variations in volume resistivity will occur in molding due to the uneven dispersion of carbon, and a phenomenon will occur in which the bias current escapes from a low volume resistivity area of the pre-transfer guide plate to ground. Alternatively, if a material is employed in which the entire pre-transfer guide plate has a uniform volume resistivity, molding conditions have to be strictly controlled, resulting in increased costs.

Therefore, in the mechanism according to the fifth aspect, a sheet member having a volume resistivity of $10^9$ to $10^{14}$ Ωcm is used as a semiconductor member. That is, a sheet member having a volume resistivity of $10^9$ Ωcm or more is provided on a portion of the second pre-transfer guide plate. This sheet member functions as a capacitor to prevent bias current from escaping through the pre-transfer guide plate to ground. In addition, if the first semiconductor member has a volume resistivity of more than $10^{14}$ Ωcm, when a transfer sheet passes by the second pre-transfer guide plate, triboelectrification may occur between the transfer sheet and the guide plates, and thus an electrical charge may be stored in the second pre-transfer guide plate and form gray streaks on a formed image. Thus, the first semiconductor member is set to have a volume resistivity of $10^{14}$ Ωcm or less.

In a transfer sheet conveyance and guide mechanism of an image forming device according to a sixth aspect of the present invention, the image carrying member is a photoconductive drum, and the transfer member is a transfer roller, and the photoconductive drum has a diameter three times or less the diameter of the transfer roller.

In the mechanism, the photoconductive drum as an image carrying member has a diameter three times or less the diameter of the transfer member. That is, the miniaturized image forming device has smaller spaces between the transfer member and the first pre-transfer guide plate provided on the transfer member side, and between the first pre-transfer guide plate and the second pre-transfer guide plate provided on the photoconductive drum side.

Therefore, through the adoption of the mechanisms described above, it is possible to inhibit bias current from escaping to ground via the pre-transfer guide plate, and also alleviate image scattering due to triboelectrification between the transfer sheet and the guide plate.

In a transfer sheet conveyance and guide mechanism of an image forming device according to a seventh aspect, the second pre-transfer guide plate is connected to ground.

A transfer sheet conveyance and guide mechanism of an image forming device according to an eighth aspect of the present invention comprises an image carrying member having a surface on which an electrostatic latent image is formed, a transfer member which is placed opposite to the image carrying member so as to form a transfer nip with the image carrying member and to which a bias voltage is applied, a transfer sheet feeding unit for feeding a transfer sheet into the transfer nip, and a transfer sheet conveyance and guide mechanism for guiding the transfer sheet from the transfer sheet feeding unit to the transfer nip. The transfer sheet conveyance and guide mechanism has a first pre-transfer guide plate and a second pre-transfer guide plate. The first pre-transfer guide plate is provided on the transfer member side upstream of the transfer nip in a transfer sheet conveying direction, and guides a transfer sheet to the transfer nip. The second pre-transfer guide plate is provided opposite to the first pre-transfer guide plate and on the image carrying member side upstream of the transfer nip in the transfer sheet conveying direction, and guides the transfer sheet to the transfer nip. The first pre-transfer guide plate is provided with a contact portion protruding toward the second pre-transfer guide plate, and the second pre-transfer guide plate is provided with a semiconductor member that is in contact with the contact portion.

In an image forming device according to a ninth aspect of the present invention, the second pre-transfer guide plate according to the eighth aspect is a resin member whose resistance is adjusted by the addition of carbon, and the semiconductor member is a sheet member having a volume resistivity of $10^9$ to $10^{14}$ Ωcm.

In an image forming device according to a tenth aspect of the present invention, the image carrying member of the eighth aspect is a photoconductive drum, the transfer member of the eighth aspect is a transfer roller, and the photoconductive drum has a diameter three times or less the diameter of the transfer roller.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Overall Configuration of an Image Forming Device

Figure 1:
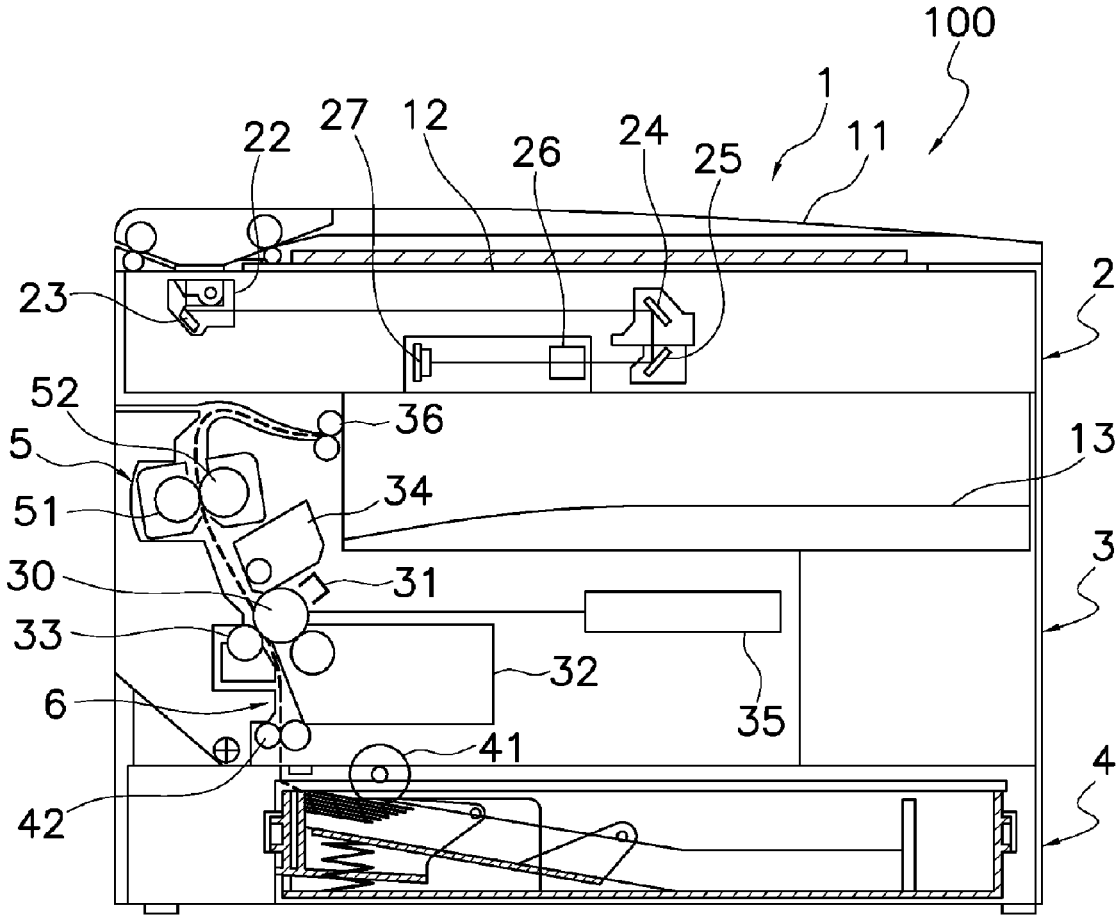
FIG. 1 is a structural view of an image forming device.

FIG. 1 shows a schematic configuration of an image forming device 100 in which one embodiment of the present invention is adopted. The image forming device 100 comprises a document platen 1, an original document reading unit 2, an image forming unit 3, a built-in discharge unit 13, and a feeding unit 4. The document platen 1 has an original document cover 11 attached so as to move up and down, and an original document mount table 12. Underneath the document platen 1 is provided the original document reading unit 2, which serves to read the image data from an original document placed on the document platen 1. The original document reading unit 2 includes a light source 22 for irradiating a surface of an original document placed on the document platen 1 with a light, mirrors 23, 24 and 25 for deflecting the light reflected from the original document surface, a lens 26 for focusing the light from the mirror 25, and an image pickup device 27 such as a CCD line sensor for receiving the light focused by the lens 26 to generate image data signals corresponding to the original document image.

The image forming unit 3 has a photoconductive drum 30 as an image carrying member, on a surface of which an electrostatic latent image is formed. In this embodiment, the photoconductive drum 30 has a diameter of 30 mm. Around the photoconductive drum 30 are disposed a main charger 31, a developing unit 32, a transfer roller 33 as a transfer unit, and a cleaning unit 34. The main charger 31 is placed at the diagonal upper right of the photoconductive drum 30 in FIG. 1, and serves to charge the surface of the photoconductive drum 30. The developing unit 32 is arranged at a predetermined space away from the main charger 31 at the diagonal lower right of the photoconductive drum 30, and serves to form a toner image on the surface of the photoconductive drum 30. The developing unit 32 contains toner particles therein, which serve to visualize the electrostatic latent image formed on the photoconductive drum 30. The transfer roller 33 is placed to the left of the photoconductive drum 30, and serves to transfer the toner image formed on the photoconductive drum 30 to a transfer sheet. In this embodiment, the transfer roller 33 has a diameter of 15.75 mm. The cleaning unit 34 is placed above the photoconductive drum 30, and serves to remove residual toner from the surface of the photoconductive drum 30. A laser unit 35 is disposed to the right of the photoconductive drum 30, and serves to form an electrostatic latent image on the surface of the photoconductive drum 30. The laser unit 35 forms an electrostatic latent image on the surface of the photoconductive drum 30 based on image data signals obtained from the image pickup device 27.

Above the photoconductive drum 30 and the transfer roller 33 is disposed a fixing device 5, which serves to fix the toner transferred on the transfer sheet by means of fusing. The fixing device 5 includes a heat roller 52 having a heater therein and a pressure roller 51 pressed against the heat roller 52, and transports a transfer sheet while pinching the transfer sheet between both the rollers in order to thermally fix the toner image formed on the transfer sheet. Further above the fixing device 5 is provided a pair of discharge rollers 36, through which the transfer sheet is discharged to an internal discharge unit 13.

Figure 2:
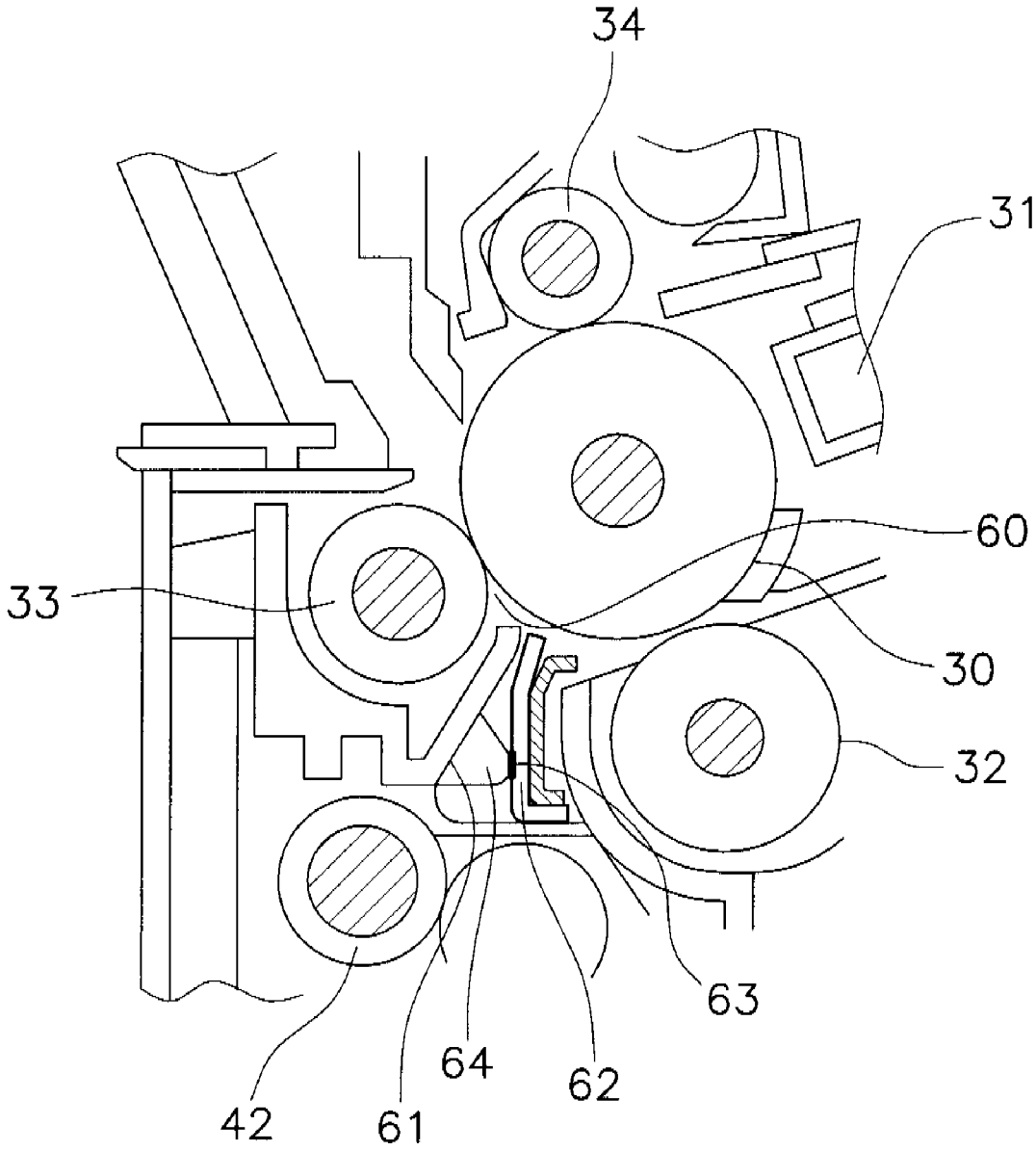
FIG. 2 is a structural view of a transfer sheet conveyance and guide mechanism.

The feeding unit 4 is provided with a pick-up roller 41 for picking up a transfer sheet from a stack thereof. A pair of paper stop rollers 42 is provided, which pauses a transfer sheet at a predetermined position in a vertical transport path. As shown in FIG. 2, above the pair of paper stop rollers 42 is provided a transfer sheet conveyance and guide mechanism 6 (transfer sheet conveyance and guide mechanism).

Structure of the Transfer Sheet Conveyance and Guide Mechanism

Next, the transfer sheet conveyance and guide mechanism 6 will be described. As shown in FIG. 2, the pair of paper stop rollers 42 is disposed at the lower left of a transfer nip 60 in FIG. 2, and the transfer sheet conveyance and guide mechanism 6 is disposed between the pair of paper stop rollers 42 and the transfer nip 60. The transfer sheet conveyance and guide mechanism 6 includes a first pre-transfer guide plate 61 on the transfer roller 33 side, and a second pre-transfer guide plate 62 on the photoconductive drum 30 side. The first pre-transfer guide plate 61 and the second pre-transfer guide plate 62 are disposed so as to guide a transfer sheet transported from the pair of paper stop rollers 42 to a suitable position on the transfer nip 60 at an adequate angle. In this embodiment, the first pre-transfer guide plate 61 and the second pre-transfer guide plate 62 are made of NC 212 (manufactured by Japan GE Plastic Co. Ltd.). The NC 212 contains 12% carbon, and has a volume resistivity of $10^6$ to $10^{10}$ Ωcm. Note that the volume resistivity has variations in this range due to the uneven distribution of carbon.

Additionally, the first pre-transfer guide plate 61 is connected to the second pre-transfer guide plate 62 via contact portions 64 provided on the first pre-transfer guide plate 61 and sheet-like semiconductor members 63 provided on the second pre-transfer guide plate 62 (described below), and there is continuity between the second pre-transfer guide plate 62 and the main body of the image forming device. The main body of the image forming device is connected to ground.

Figure 3:
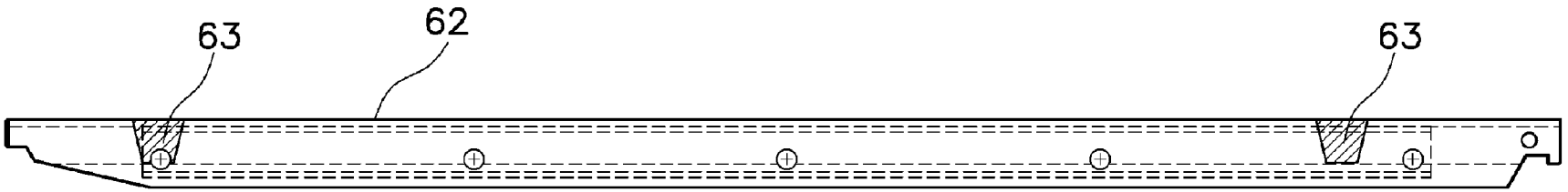
FIG. 3 is a structural view of a pre-transfer guide plate 62.

As shown in FIG. 3, the second pre-transfer guide plate 62 has the sheet-like semiconductor members 63 at both ends in a lengthwise direction (the direction vertical to the transfer sheet conveyance direction). Here, the semiconductor members 63 have a volume resistivity of $10^8$ to $10^{14}$ Ωcm. Note that the sheet-like semiconductor members 63 are positioned at both the ends of the second pre-transfer guide plate 62 so as not to cause any trouble with transfer sheet conveyance. Similarly, the contact portions 64 provided on the first pre-transfer guide plate 61 are positioned at both the ends of the first pre-transfer guide plate 61 so as not to cause any trouble with transfer sheet conveyance.

Image Forming Operation

First, a simplified description of an image forming operation will be provided. When the power supply to the image forming device 100 is turned on, various parameters for control are initialized, and the temperature of the fixing device 5 is set, for example. After an original document is placed on the original document mount table 1, and a start key (not shown in the drawings) is operated, an image forming operation is started. In the image forming operation, image data is first read by the original document reading unit 2. In the image forming unit 3, the photoconductive drum 30 is charged by the main charger 31, and is also exposed by a light from the laser unit 35 based upon the image data in order to form an electrostatic latent image on the surface. Then, the electrostatic latent image is developed by the developing unit 32. Meanwhile, a transfer sheet from the feeding unit 4 is upwardly transported via the pair of paper stop rollers 42, and guided to a transfer position by the transfer sheet conveyance and guide mechanism 6. Then, the toner image is transferred to the transfer sheet by the transfer roller 33, and fixed by means of the heat and pressure of the fixing device 5. Finally, the transfer sheet is discharged to the built-in discharge unit 13. The residual toner remaining on the photoconductive drum 30 is cleaned by the cleaning unit 34, and then discharged to a waste toner container (not shown in the drawings).

Next, a detailed description of the transfer process and the conveyance of the transfer sheet will be provided. As shown in FIGS. 1 and 2, in performing an image forming operation with the image forming device, a transfer sheet is fed from the feeding unit 4, and then upwardly transported by the pair of paper stop rollers 42. At this time, a bias voltage is applied to the transfer roller 33 from a bias power source (not shown in the drawings). When the transfer sheet is guided to the transfer nip 60 by the transfer sheet conveyance and guide mechanism 6, a toner image formed on the photoconductive drum 30 is transferred to the transfer sheet by means of the bias voltage applied to the transfer roller 33.

Here, since the photoconductive drum 30 has a diameter of 30 mm and the transfer roller 33 has a diameter of 15.75 mm, the surface area of the transfer nip 60 is very narrow. Accordingly, in order to guide a transfer sheet into a suitable position on the transfer nip 60, the space between the transfer roller 33 and the first pre-transfer guide plate 61, and the space between the first pre-transfer guide plate 61 and the second pre-transfer guide plate 62, have to be narrow. In the above-mentioned situation, when a bias voltage is applied to the transfer roller 33, a transfer bias current may flow through the first pre-transfer guide plate 61 to the second pre-transfer guide plate 62. However, in this embodiment, since the sheet-like semiconductor members 63 having a volume resistivity of $10^9$ to $10^{14}$ Ωcm are provided in the passage between the first pre-transfer guide plate 61 and the main body of the image forming device 100, it is possible to prevent the bias current from escaping to ground.

Here, an experiment was conducted in order to determine the optimal value of the volume resistivity of the semiconductor members 63, wherein the photoconductive drum 30 had a diameter of 30 mm, the transfer roller 33 had a diameter of 15.75 mm, and each of the pre-transfer guide plates 61 and 62 was made of NC 212 (manufactured by Japan GE Plastic Co. Ltd.) having a content of 12% carbon and a volume resistivity of $10^5$ to $10^{10}$ Ωcm. The experimental results are shown in Table 1, with "circle" indicating "good", "triangle" indicating "acceptable", and "X" indicating "poor".

TABLE 1

| | | Resistance value of semiconductor member (logarithmic value) | | | | | | | | | | |
|---|---|---|---|---|---|---|---|---|---|---|---|---|
| | | 6 | 7 | 8 | 9 | 10 | 11 | 12 | 13 | 14 | 15 | 16 |
| Resistance value of pre-transfer guides (logarithmic value) | 5 | x | x | Δ | ○ | ○ | ○ | ○ | ○ | ○ | Δ | Δ |
| | 6 | x | x | Δ | ○ | ○ | ○ | ○ | ○ | ○ | Δ | Δ |
| | 7 | x | x | Δ | ○ | ○ | ○ | ○ | ○ | ○ | Δ | Δ |
| | 8 | x | x | Δ | ○ | ○ | ○ | ○ | ○ | ○ | Δ | Δ |
| | 9 | ○ | ○ | ○ | ○ | ○ | ○ | ○ | ○ | ○ | Δ | Δ |
| | 10 | ○ | ○ | ○ | ○ | ○ | ○ | ○ | ○ | ○ | Δ | Δ |

As shown in Table 1, the volume resistivity of the semiconductor members 63 was within the range of $10^6$ to $10^{16}$ Ωcm. Here, if the material that forms the pre-transfer guide plates 61 and 62 has a volume resistivity of $10^9$ to $10^{10}$ Ωcm, image defects such as defective transfer and character scattering will not occur so as long as the volume resistivity of the semiconductor members 63 was equal to or less than $10^{14}$ Ωcm. On the other hand, if the volume resistivity of the material that forms the pre-transfer guide plates 61 and 62 was smaller than $10^9$ Ωcm, image defects such as defective transfer and character scattering will not occur so as long as the volume resistivity of the semiconductor members 63 was within the range of $10^9$ to $10^{14}$ Ωcm.

In conclusion, as understood from Table 1, since it is possible to prevent a bias current from flowing to ground via the pre-transfer guide plates 61 and 62 if the volume resistivity of the semiconductor members 63 is equal to or more than $10^9$ Ωcm, it is possible to prevent image defects such as defective transfer and character scattering. If the volume resistivity of the semiconductor members 63 is equal to or less than $10^{14}$ Ωcm, a charge storage due to triboelectrification between the transfer sheet and the pre-transfer guide plates 61 and 62 will not occur, and thus image defects such as gray streaks will not occur in the formed image. Accordingly, in view of the variations in the volume resistivity of the pre-transfer guide plates 61 and 62, it is preferable that the volume resistivity of the semiconductor members 63 is within the range of $10^9$ to $10^{14}$ Ωcm.

Since sheet-like semiconductor members 63 having a volume resistivity of $10^8$ to $10^{14}$ Ωcm are provided along the passage between the second pre-transfer guide plate 62 on the photoconductive drum 30 side and the main body of the image forming device 100, it is possible to prevent a bias current from flowing through the pre-transfer guide plates 61 and 62 to ground. Also, the occurrence of charge storage due to triboelectrification between the transfer sheet and the pre-transfer guide plates 61 and 62 can be inhibited. Thus, it is possible to alleviate the occurrence of image defects such as defective transfer and character scattering, by utilizing a simple structure.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2005-006902. The entire disclosure of Japanese Patent Application No. 2005-006901 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A transfer sheet conveyance and guide mechanism of an image forming device, the image forming device comprising an image carrying member having a surface on which an electrostatic latent image is formed and a transfer member that is disposed opposite to the image carrying member so as to form a transfer nip with the image carrying member and to which a bias voltage is applied, the transfer sheet conveyance and guide mechanism comprising:

a first pre-transfer guide plate being configured to guide a transfer sheet to the transfer nip, the first pre-transfer guide plate being provided on the transfer member side upstream of the transfer nip in a transfer sheet conveying direction; and a second pre-transfer guide plate being provided opposite to the first pre-transfer guide plate to guide the transfer sheet to the transfer nip, the second pre-transfer guide plate being provided on the image carrying member side upstream of the transfer nip in the transfer sheet conveying direction, the first pre-transfer guide plate being provided with a first contact portion protruding toward the second pre-transfer guide plate, and the second pre-transfer guide plate being provided with a first semiconductor member contacting the first contact portion.

2. The transfer sheet conveyance and guide mechanism of an image forming device according to claim 1, wherein the first and second pre-transfer guide plates extend in a direction orthogonal to the transfer sheet conveying direction, and each of the first contact portion and the first semiconductor member is provided at one end of each of the pre-transfer guide plates in a lengthwise direction.

3. The transfer sheet conveyance and guide mechanism of an image forming device according to claim 2, wherein the first pre-transfer guide is provided with a second contact portion protruding toward the second pre-transfer guide plate at the other end in the lengthwise direction, and the second pre-transfer guide plate is provided with a second semiconductor member in contact with the second contact portion at the other end in the lengthwise direction.

4. The transfer sheet conveyance and guide mechanism of an image forming device according to claim 3, wherein both the space between the first and second contact portions, and the space between the first and second semiconductor members, are wider than the width of the transfer sheet.

5. The transfer sheet conveyance and guide mechanism of an image forming device according to claim 1, wherein the second pre-transfer guide plate is a resin member whose resistance is adjusted by the addition of carbon, and the first semiconductor member is a sheet member having a volume resistivity of $10^9$ to $10^{14}$ Ωcm.

6. The transfer sheet conveyance and guide mechanism of an image forming device according to claim 1, wherein the image carrying member is a photoconductive drum, and the transfer member is a transfer roller, and the photoconductive drum has a diameter three times or less the diameter of the transfer roller.

7. The transfer sheet conveyance and guide mechanism of an image forming device according to claim 1, wherein the second pre-transfer guide plate is connected to ground.

8. An image forming device, comprising:

an image carrying member having a surface on which an electrostatic latent image is formed;

a transfer member being arranged opposite to the image carrying member so as to form a transfer nip with the image carrying member, and to which a bias voltage is applied;

a transfer sheet feeding unit being configured to feed a transfer sheet into the transfer nip; and a transfer sheet conveyance and guide mechanism configured to guide the transfer sheet from the transfer sheet feeding unit to the transfer nip, the transfer sheet conveyance and guide mechanism having a first pre-transfer guide plate being configured to guide the transfer sheet to the transfer nip, the first pre-transfer guide plate being provided on the transfer member side upstream of the transfer nip in a transfer sheet conveying direction, and a second pre-transfer guide plate being provided opposite to the first pre-transfer guide plate guiding the transfer sheet to the transfer nip, the second pre-transfer guide plate being provided on the image carrying member side upstream of the transfer nip in the transfer sheet conveying direction, first pre-transfer guide plate being provided with a contact portion protruding toward the second pre-transfer guide plate, and the second pre-transfer guide plate being provided with a semiconductor member contacting the contact portion.

9. The image forming device according to claim 8, wherein the second pre-transfer guide plate is a resin member whose resistance is adjusted by the addition of carbon, and the semiconductor member is a sheet member having a volume resistivity of $10^9$ to $10^{14}$ Ωcm.

10. The image forming device according to claim 8, wherein, the image carrying member is a photoconductive drum, the transfer member is a transfer roller, and the photoconductive drum has a diameter three times or less the diameter of the transfer roller.

* * * * *